United States Patent [19]

Murray

[11] Patent Number: 4,503,117

[45] Date of Patent: Mar. 5, 1985

[54] PAPER-POLYMER PRODUCT

[75] Inventor: James G. Murray, East Brunswick, N.J.

[73] Assignee: Mobil Oil Corporation, New York, N.Y.

[21] Appl. No.: 566,987

[22] Filed: Dec. 30, 1983

[51] Int. Cl.[3] ..... B05D 5/00

[52] U.S. Cl. ..... 428/311.7; 264/128; 427/243

[58] Field of Search ..... 264/128; 427/243; 428/311.7

[56] References Cited

U.S. PATENT DOCUMENTS

| | | | |
|---|---|---|---|
| 1,686,497 | 8/1928 | Brown et al. | 427/243 |
| 2,289,339 | 7/1942 | Brennan | 427/243 |
| 2,717,841 | 9/1955 | Biefield et al. | 427/243 |
| 3,825,007 | 7/1974 | Rand | 428/311.7 |
| 4,051,214 | 9/1977 | Casper et al. . | |
| 4,271,227 | 6/1981 | Muller et al. . | |
| 4,349,616 | 9/1982 | Parker | 428/311.7 |

*Primary Examiner*—James C. Cannon

*Attorney, Agent, or Firm*—Alexander J. McKillop; Michael G. Gilman; Charles J. Speciale

[57] ABSTRACT

A paper-polymer product as a fibrous, open web structure with polymer within the fiber structure of the cellulose fibers. The polymer is formed in-situ from a liquid, non-polar vinyl monomer such as p-chlorostyrene or p-methylstyrene. The open spaces of the fibrous web structure are substantially free from polymer.

9 Claims, 4 Drawing Figures

PAPER-POLYMER PRODUCT

BACKGROUND OF THE INVENTION

1. Field of the Invention

The present invention is directed to a paper-polymer product including cellulose fibers, in which the polymer is dispersed within the fiber structure of the cellulose fibers. More particularly, the invention is directed to such a product in which the void spaces of the fibrous web are substantially free from the polymer. Such a product can be used in place of plain paperboard or pulpboard in making containers.

2. Description of the Prior Art

U.S. Pat. No. 4,051,214 to Casper et al describes a method for controlling monomer lost during production of a fiber-thermoplastic matrix. A fibrous web of less than $\frac{1}{4}$ inch thickness is saturated with a liquid, vinyl monomer and a free radical initiator is polymerized under controlled conditions. Lines 51–60 of column 3 of the patent indicate that it is necessary for the voids of the fibrous web to hold the liquid monomer.

U.S. Pat. No. 4,271,227 to Muller et al describes a transparent, non-stratified, three dimensional resin reinforced fibrous sheet. Monomers of the Formula I in column 4 of the patent are used to fill voids in the sheet of fibrous material. See line 2 of column 5 of the patent.

SUMMARY OF THE INVENTION

It is an object of the present invention to provide a paper-polymer product which has improved wet-strength retention while maintaining the fibrous nature of the paper.

It is a further object of this invention to provide such a product which can be manufactured easily.

The above objects and others are obtained by providing a fibrous web including cellulose fibers. The web is treated with a liquid, non-polar vinyl monomer in an amount so that the monomer stays within the fiber structure of the cellulose fibers, while the open spaces of the web remain substantially free of the monomer. The monomer then is polymerized, leaving a structure in which polymer is present within or at the surface of the structure of the cellulose fibers, while the open spaces of the web remain free from the polymer, thus preserving the essential fibrous nature of the web.

DETAILED DESCRIPTION OF THE INVENTION

Figure 1:
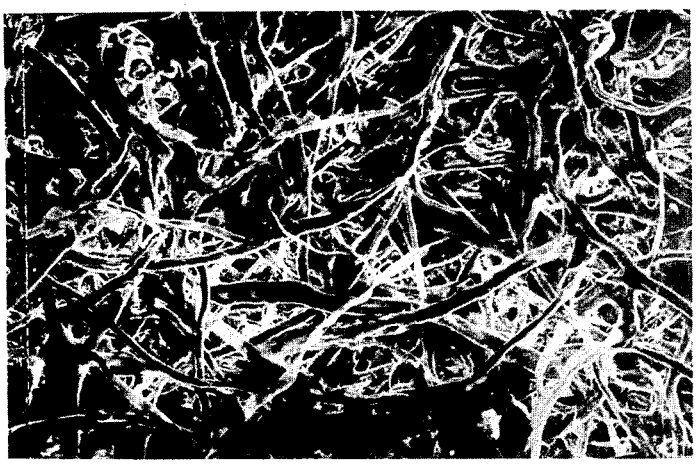
FIG. 1 is a 100X scanning electron microscopy photograph of cellulosic fibers according to the present invention.

The present invention is based on the discovery that polar cellulose fibers will absorb and uniformly diffuse even highly non-polar monomers throughout their structures. This diffusion is independent of the moisture content of the cellulose fibers, even up to saturation levels in a sheet of paper. For example, if one end of a paper strip is immersed in a monomer solution, rapid wicking occurs up the paper strip until the paper becomes saturated. The rate of the wicking process is independent of the water content of the paper, even between a totally dry paper strip and one which has been placed in a 100% humidity environment, where the paper has a moisture content of 15–16% and might be expected to act as if it were a surface covered by a sheet of water. If the end of the strip is allowed to remain in the monomer, the wicking continues until the void space in the paper strip is totally filled. If the end of the strip is removed after a short immersion time, spreading will continue as long as evaporation of the monomer is prevented, and it has been discovered that the non-polar monomer will remain within the fiber structure of the cellulose fibers, leaving the void spaces of the web substantially free from monomer, and consequently substantially free from polymer after polymerization.

The present invention is useful for a wide variety of materials, so long as cellulose fibers are included. Such materials include paper, paperboard, cardboard, corrugated cardboard and pulpboard. Blended materials, such as cellulose-polymer blends, also are contemplated. The polymer within the fiber structure is formed from a liquid, non-polar vinyl monomer. Examples of such monomers include acrylates and styrenic monomers such as styrene, p-chlorostyrene and p-methylstyrene. These three styrene monomers are preferred.

As will be discussed more fully below, the product of the present invention shows improved wet-strength retention over untreated products. However, the product of the present invention is somewhat more brittle than an untreated product. The amount of polymer with respect to the amount of cellulose fibers will vary, depending upon the specific desired application. If dry strength is not particularly important, but wet strength is, relatively large amounts of polymer will be used. If less wet strength retention is required and less brittleness is desired, smaller amounts of polymer will be used. It is expected that if the amount of polymer is more than about 40% of the weight of the cellulose fibers, polymer will begin to fill the voids of the web, thus undesirably destroying the fibrous nature of the web. On the other hand, if the amount of polymer is less than about 2.5% of the weight of the cellulose fibers, the properties of the product treated with the polymer will not be much different from those of the untreated product. The preferred range is about 3–30%. The polymerization should be carried out in a sealed container. In this manner, very little monomer is lost from the fibers during polymerization. Thus, the amount of monomer added should be virtually the same as the amount of polymer desired. The polymerization proceeds within the fibers in a manner similar to known polymerizations outside of the fibers. Thus, polymerization conditions, such as time, temperature, initiator and initiator concentration, can be selected from those currently in use, depending upon the product desired. It is preferred that the conditions be selected to provide a polymer having a number average molecular weight of at least 50,000 or a weight average molecular weight of at least 100,000. A number average of molecular weight of at least 100,000 is preferred.

EXAMPLE

Para-methylstyrene monomer containing t-butyl peracetate initiator was spotted onto blotterboard or paper sheets at various add-on levels, and the materials were placed in capped bottles to allow the monomer to distribute itself uniformly. Dye was used to determine when uniform coverage had been achieved. The bottles then were blown out with nitrogen and placed in an oven overnight at 105°–110° C. for polymerization.

The amount of the initiator was about 0.5%. The molecular weight of the polymerized monomer was believed to be 500,000–700,000 weight average and 100,000–120,000 number average. This molecular weight is within the known desirable molecular weight range for poly-paramethylstyrene.

The properties of paper hand sheets on which paramethylstyrene was polymerized at 3 and 20% add on levels are given in Table I below. As can be seen, the dry tensile strength with 20% loading drops to 40% of that of the untreated paper, but 90–100% of this strength is retained under wet conditions. It is believed that the reduction in tensile strength is probably due to an increased rigidity of the matrix structure, which results in tearing failure at reduced loading. Note that the untreated paper retained only very small amounts of tensile strength under wet conditons. It also was discovered that the flexural modulus of a sample blotterboard in which 25% paramethylstyrene monomer had been polymerized was increased by 6–9 times. It is possible to heat form these in-situ polymerized sheets by pressing at 125° C. The samples retained the shape formed during the hot pressing.

TABLE I

Properties of Paper Handsheets Containing In-Situ Polymerized Paramethylstyrene

| Treatment | Basis Weight g/m$^2$ | Caliper mm | Density g/cm$^3$ | Cobb g/m$^2$ | Dry Tensile km* | Wet Tensile km* | Wet Strength Retention % |
|---|---|---|---|---|---|---|---|
| None | 108 | .213 | .51 | — | 5.5 | .30 | 5.5 |
| None | 102 | .192 | .52 | — | 5.9 | .10 | 1.7 |
| PMS 3% Load | 108 | .208 | .52 | 35.7 | 4.0 | .60 | 15.0 |
| PMS 20% Load | 117 | .211 | .56 | 17.8 | 2.1 | 1.90 | 90.5 |
| PMS 20% Load | 122 | .218 | .56 | 17.3 | 2.4 | 2.40 | 100.0 |

*Break Length—(A Tappi measurement of tensile strength)

The properties provided by this in-situ polymerization could be useful in virtually any application where the advantages of higher flexural modulus, wet strength and heat formability would not be offset by the increased brittleness of the board. Examples of such uses have been outlined previously. In-situ polymerization would be inexpensive since the monomer impregnation is simple and polymerization would be relatively simple, and could be carried out under conventional polymerization conditions. This technique of polymerization could be carried out on a large scale by spraying the paper or other fibrous web with monomer-initiator and winding it into a roll. The roll could be wrapped with a plastic sheet and then placed in an oven for a period of time to finish the polymerization. At the moderate add on levels of monomer, the reaction should be easily controlled, despite the thermic nature of the polymerization. Any problems with odors from polymerization by-products can be controlled by passing the sheet through an oven or over a hot roll.

Figure 2:
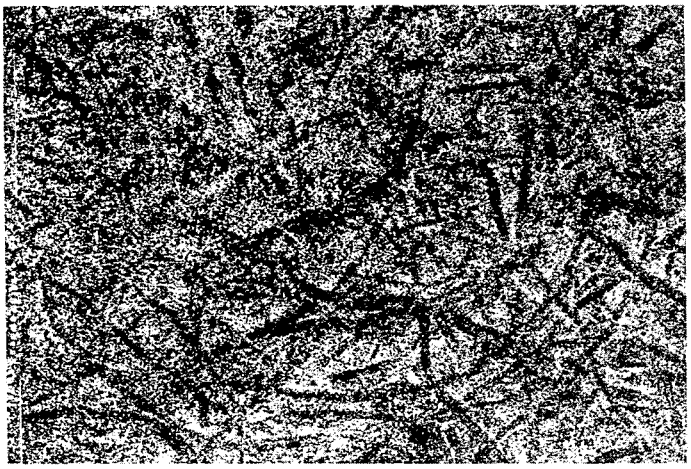
FIG. 2 is a chlorine X-ray spectra mapping of the fibers shown in FIG. 1.
Figure 3:
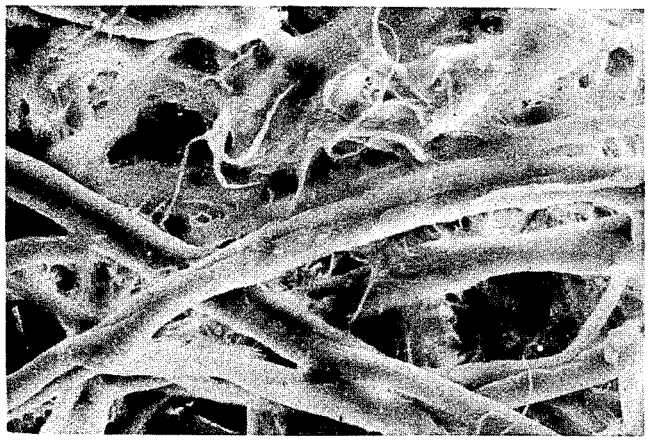
FIG. 3 is a 500X scanning electron microscopy photograph of cellulosic fibers according to the present invention.
Figure 4:
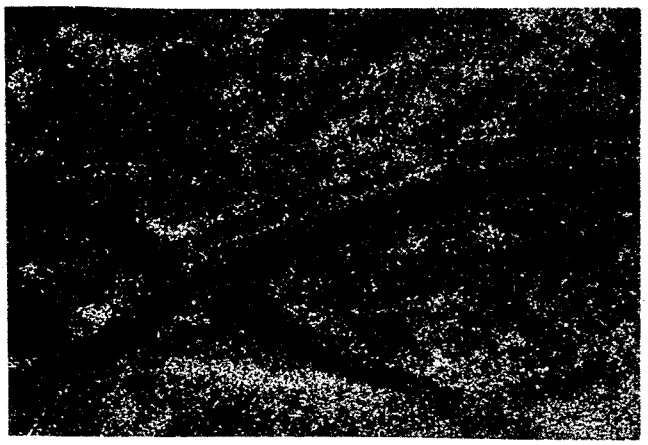
FIG. 4 is a chlorine X-ray spectra mapping of the fibers shown in FIG. 3.

The distribution of in-situ polymerized polymer in a paper matrix was evaluated by polymerizing p-chlorostyrene at a 22% level in a paper sheet and observing the distribution of the polymer in the resulting composition by a combination of scanning electron microscopy (sem) and X-ray spectral mapping of chlorine atoms. The sem photographs (FIGS. 1 and 3) show relatively little change in the fiber pattern and suggest that the bulk of the polymer is in the interior of the fibers, although there are a few areas that suggest aggregates of polymer exterior to the fibers, i.e. at the surface. The chlorine mappings (FIGS. 2 and 4) show a broad distribution of the polyer throughout the pulp matrix, with some areas of the fiber appearing to have a higher concentration of polymer at the surface of the fiber.

Although a detailed description of the invention has been provided above, modifications will be apparent to those skilled in the art which do not depart from the spirit and scope of this invention. Thus, the invention is not limited by the above description, but rather is defined by the following claims.

I claim:

1. A fibrous composition, comprising:

a web comprising a plurality of intersectng cellulose fibers forming an open web structure having spaces;

a polymer within the fibrous structure of the individual cellulose fibers or at the surface of the individual cellulose fibers, formed in-situ from a liquid, non-polar vinyl monomer;

the spaces of said open web structure being substantially free from said polymer so that said web maintains a fibrous character.

2. The composition of claim 1, wherein said monomer is selected from the group consisting of acrylate monomers, styrenic monomers and mixtures thereof.

3. The composition of claim 2, wherein said monomer is selected from the group consisting of p-chlorostyrene and p-methylstyrene.

4. The composition of claim 1, wherein said polymer is present in the amount of not more than 40% of the weight of said cellulose fibers.

5. The composition of claim 1, wherein said polymers present in the amount of at least 2.5% of the weight of said cellulose fibers.

6. The composition of claim 1, wherein said polymer is present in the range of about 3–30% of the weight of said cellulose fibers.

7. The composition of claim 1, wherein said web is paper.

8. The composition of claim 1, wherein the polymer has a number average molecular weight of at least 50,000.

9. The composition of claim 8, wherein the molecular weight is at least 100,000.

* * * * *